US007473215B2

(12) United States Patent
Moen

(10) Patent No.: US 7,473,215 B2
(45) Date of Patent: Jan. 6, 2009

(54) SHIPPING CONTAINER AND METHOD OF MANUFACTURING SAME

(75) Inventor: Lenard E. Moen, Whittier, CA (US)

(73) Assignee: Moen Industries, Inc., Santa Fe Springs, CA (US)

( * ) Notice: Subject to any disclaimer, the term of this patent is extended or adjusted under 35 U.S.C. 154(b) by 540 days.

(21) Appl. No.: 11/074,355

(22) Filed: Mar. 7, 2005

(65) Prior Publication Data

US 2006/0196920 A1 Sep. 7, 2006

(51) Int. Cl.
*B31B 1/60* (2006.01)

(52) U.S. Cl. ..... 493/114; 493/128

(58) Field of Classification Search ..... 493/114, 493/121, 128, 130, 141; 229/122.21, 122.23, 229/122.24, 190, 191, 192, 198
See application file for complete search history.

(56) References Cited

U.S. PATENT DOCUMENTS 3,456,563 A * 7/1969 Moen et al. ..... 493/114
3,650,183 A * 3/1972 Striplin ..... 493/141
3,659,505 A * 5/1972 Wasyluka et al. ..... 493/102
3,709,425 A * 1/1973 Stapp ..... 229/122.24
4,345,905 A * 8/1982 Moen ..... 493/171
4,948,033 A * 8/1990 Halsell et al. ..... 229/122.24
5,950,915 A * 9/1999 Moen ..... 229/112.24
6,520,898 B1 * 2/2003 Moen ..... 493/128
6,719,191 B1 * 4/2004 Christensen et al. ..... 229/191
2003/0168502 A1 * 9/2003 Kisch ..... 229/122.24

* cited by examiner

*Primary Examiner*—Louis K Huynh
(74) *Attorney, Agent, or Firm*—Christie, Parker & Hale, LLP.

(57) ABSTRACT

A container formed of an erected body blank and a pair of erected wall blanks made of corrugated board material, and a method of forming same. The body blank has a bottom panel and an erected, upstanding pair of end wall panel areas at opposite ends of said bottom panel. Each of the pair of wall blanks has an end wall portion and at least one extension portion. The erected pair of wall blanks are disposed generally along a perimeter of the bottom panel of the erected body blank adjacent to the end wall panels such that the end wall portions of the pair of wall blanks and the upstanding pair of end wall panel areas of the body blank are attached together, and the at least one extension portion extends inside of the perimeter of the bottom panel.

4 Claims, 6 Drawing Sheets

SHIPPING CONTAINER AND METHOD OF MANUFACTURING SAME

BACKGROUND

The present invention relates to paperboard containers and, more particularly, to a shipping container of corrugated liner board material and method for manufacturing same.

RSC (regular slotted container) and HSC (half slotted container) boxes are in common use in shipping a variety of products where it is desired to have complete protection of the product, i.e., protection against both shipping damage and pilferage. However, such containers have distinct disadvantages which are inherent in their basic design. Thus, in the case of both the RSC and HSC containers, the bottom closure comprises foldable bottom flaps which are interleaved when folded to provide a two-ply floor for the product, the floor having gaps. In the case of the RSC container, the lid is also comprised of interleaved foldable top flaps. The double thickness of the material in both the bottom and top of such containers comprising the overlapping portions of the folded flaps contribute nothing to the stacking strength of the container and thus are useful only in the sense of protection of the product against pilferage. Accordingly, there has been a long felt need for a shipping container design, which without increasing the amount of corrugated board used, results in a shipping container of increased stacking strength that has a gapless floor, and yet provides complete protection of the shipped product against pilferage.

Although sometimes so employed, HSC and RSC containers are ill adapted to serve as display containers. When so used, they are provided with a tear out panel or panels in a side wall or opposite side walls of the container. When these are removed, the stacking strength of the container is greatly reduced, comprising substantially only the single ply or thickness of corrugated liner board in the opposite end walls. These end walls, although intact, are then prone to buckling in view of the removal of the tear out panels of the side walls.

Moreover it would be desirable for shipping containers to be provided with one or more sides already opened so that the goods in the container are partially exposed and accessible without greatly affecting the strength and structural integrity of the containers.

A related concern with shipping containers is that when the strength is built solely into the outer perimeter walls thereof, an offset vertical force, such as may be caused by a box that is stacked on top which is offset, may cause the underlying box to collapse or crush.

It is thus an object of the present invention to overcome the foregoing and other disadvantages of HSC and RSC containers.

BRIEF DESCRIPTION

The invention comprises an improved shipping container of corrugated liner board. The invention further comprises a set of a pair of wall blanks in combination with a body wrap blank and a method for their assembly. The body wrap blank may optionally be formed with a pair of integral panel areas at opposite ends which, when erected, co-act to provide a lid or cover for the completed container. For added strength, the wall blanks have portions that deviate from aligning with the outer perimeter of the box's bottom.

Each wall blank comprises a generally rectangular piece of liner board having a corrugated medium sandwiched between an opposite pair of paper liners or layers. The wall blanks are traversed by a plurality of fold lines, such as made by press scores on one of the liners, preferably in a direction paralleling the flutes of the corrugated media and generally corresponding to the vertical dimension of the completed box (less the thickness of the bottom wall and any top.) The fold lines divide the wall blank into one or more wall panel areas and optionally one or more extension areas that are to extend inside of the perimeter of the box's bottom. The extension areas can comprise diagonally extending corner areas, T-bar areas, and other areas that extend inside of the perimeter areas of the box. The one or more wall panel areas can comprise an end wall and one or more side portions and optional side flaps, the two or more walls are either the same or dissimilar lengths, depending on the desired dimensions of the completed box, with or without tear out sections located on the side wall portion. If a display box is desired without need to tear free any tear out sections the one or more wall panel areas can comprise an end wall with two corner sections that when fully assembled, leave one or both sides of the completed box substantially opened. The body blank is also made of a corrugated liner board material of generally rectangular form and of a weight that may be the same as or different from the stock of which the companion wall blanks are made. A transverse parallel pair of fold lines, which may be press scored on an inside paper liner, divide the blank into a central bottom panel and a pair of end wall areas on opposite ends of the bottom panel. The corrugated medium of the body wrap blank is preferably oriented in a direction to orient the flutes of the end wall areas vertically when the box is completed. Opposite sides of the bottom panel and both of the end wall areas have integrally formed marginal flaps which will be adhesively secured to confronting marginal areas of the erected wall members upon erection of the body wrap blank.

In the fully erected container, the marginal flaps of the end wall areas comprise rigid corner posts which in combination with the double thickness laminated end walls provide a container of improved stacking strength. In addition, the extension portions of the wall blanks (diagonal corner areas, T-bar areas, etc.), which in their fully oriented position will lie outside of the outer perimeter of the bottom of the box, act to extend the area of the box where vertical support is provided. Thus, vertical support is extended from just the outer perimeter regions of the box to extend inwardly into other areas of vertical support of the box which enhances the stacking strength of the box. Particularly in the case, for example where a plurality of cylindrical objects are being placed in the fully assembled box, normally the vertical corners of the box are not occupied and can thus accommodate diagonally located corner areas. In the case of the extension portions comprising T-bars, such T-bars can not only serve to increase vertical stacking strength, but also to act as separators of objects placed in the completed box.

Optionally, opposite ends of the body blank may each be formed with a cover or lid panel area that is integral with the corresponding end wall panel. Each lid panel area may also be flanked by a pair of marginal flaps such that when the lid panels are moved to a closed position to cover the box opening, the marginal flaps may be turned into engagement with and secured to upper end marginal areas of the erected wall panels.

The container of this invention is also adapted to serve as a display container without any significant loss of its stacking strength. As each of the opposite side walls is framed by a pair of corner posts and a bottom horizontal window flange, a tear out panel of any desired configuration may be performed in the side wall which can be manually removed thus exposing contents of the container to view and removal through the thus formed display opening. If a display box is desired without need to tear free any tear out sections the one or more wall panel of the wall blank can comprise an end wall with two corner sections that when fully assembled, leave a side of the completed box substantially opened. In either case, as the two-ply end walls of the container remain intact, reinforced by the corner posts, the container stacking strength is maintained despite the removal of the material of the tear out panels or its absence in the first place.

DETAILED DESCRIPTION

Figure 1:
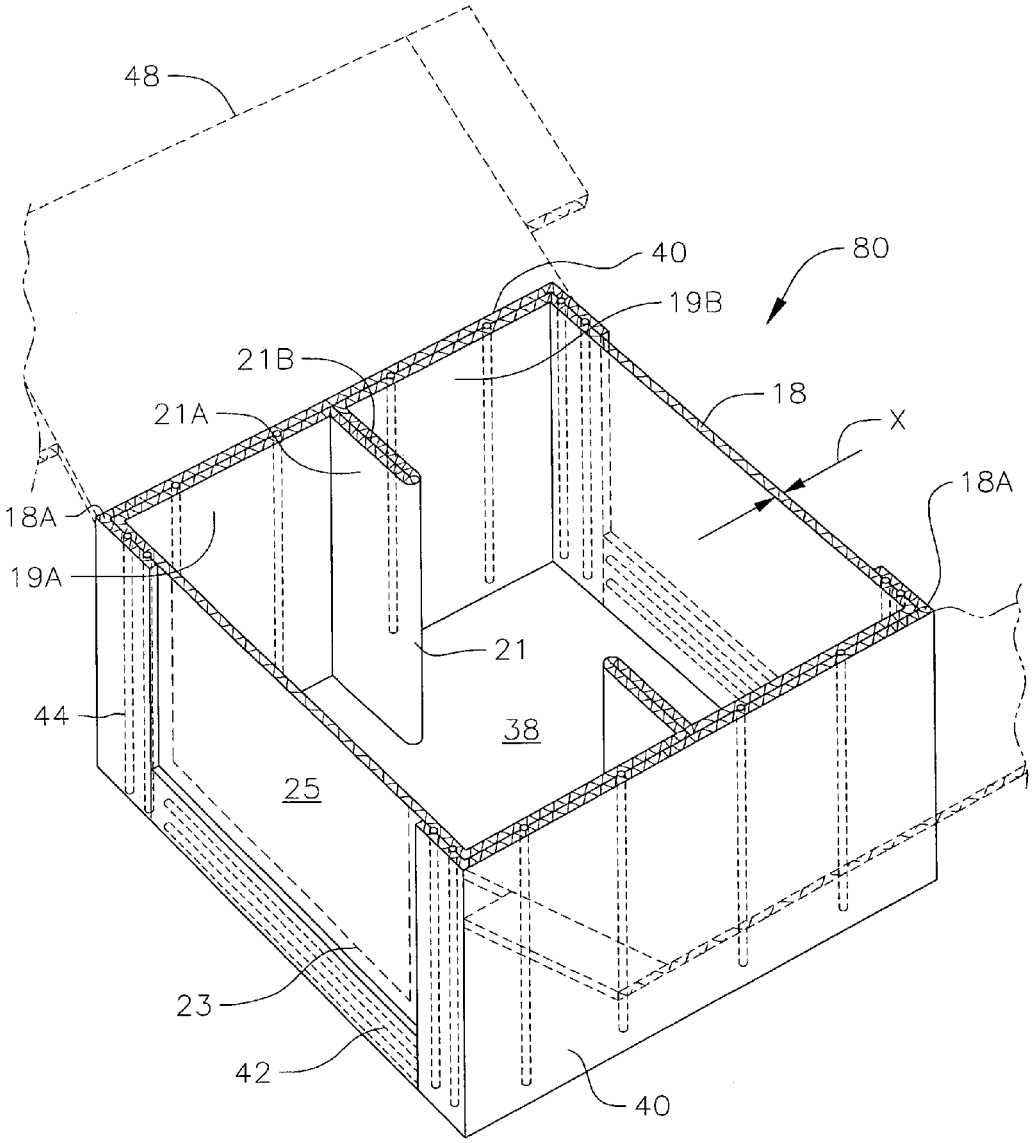
FIG. 1 is a perspective view of an embodiment of a container of the invention with extension portions and also illustrates, in phantom outline, optional cover panels integrated with the body blank and shown in a container open position.

Before explaining the invention in detail, it is to be understood that the invention is not limited in its application to the details of construction and arrangements of the components set forth in the following description or illustrated in the drawings. The invention is capable of other embodiments and of being practiced and carried out in various ways. Also, it is to be understood that the phraseology and terminology (e.g., top, bottom, inner, outer, end wall, side wall) employed herein is for the purpose of description and should not be regarded as limiting.

Figure 2:
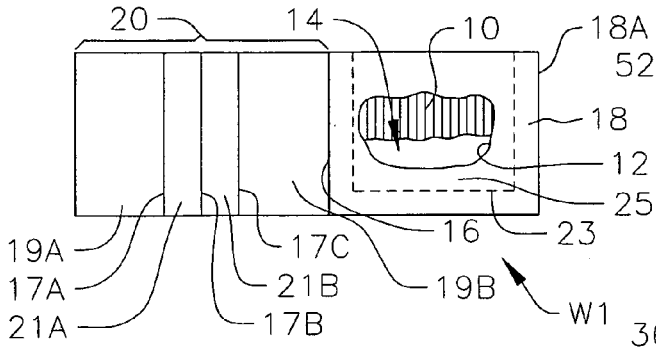
FIG. 2 is a plan view of one of the wall blanks of FIG. 1, with a portion of one liner cut away to reveal the orientation of the flutes of the corrugated medium and to show the other liner.

FIG. 2 is a plan view of a flat wall blank W1 of rectangular planform. Wall blank W is a piece of corrugated liner board comprising a corrugated medium 10 of paper sandwiched between and adhesively secured to an opposite pair of planar paper liners comprising inner layer 12 and outer layer 14. Wall blank W1 is traversed by a first fold line 16 in a direction corresponding to the vertical dimension of a completed container and parallel to the flutes of the corrugated medium 10. Typically, the fold line 16 may be a press score impressed on the inner liner 12 of the blank, although other means of defining a fold line may be used such as, e.g., a perforation score, as is well understood in the corrugated board making art. The area of the blank W1 is thus divided into a pair of major wall areas on opposite sides of the fold line 16, with one major wall area being the side wall 18, and the other major side being the end wall 20. Additional fold lines 17A, 17B and 17C are formed in major wall section 20, dividing it into first end wall portion 19A and second end wall portion 19B, with T-extension portions 21A and 21B positioned therebetween and defined by press score lines 17A and 17B (for T-extension portion 21A) and press score lines 17B and 17C (for T-extension portion 21B.) The widths of T-extension portions 21A and 21B are equal so that when folded perpendicularly from the plan of end wall sections 19A and 19B, the T-extension portions 21A and 21B will be folded and connected together. If it is desired that the T-extension portion 21 be centered in end wall, then first end wall portion 19A and second end wall portion 19B will be of equal width. It is also possible for end wall to include more than one T-extension, in which case additional score lines will be formed in major wall portion 20. Side walls 18 and end walls 20 need not necessarily be of the same size. In other words, the walls 18 and 20 may be of dissimilar lengths. Thus, if a narrower box were desired, fold line 16 can be shifted far to the right from the position of FIG. 2. The length of resulting T-extension portion 21 is determined by the lengths of T-extension portions 21A and 21B. If it is desired that portions of the sidewall portion 18 be removed to convert the completed, completely closed shipping container from a shipping container to a display container, cut lines 23 can be formed in the corrugated cardboard, which cut lines 23 will allow a tear out panel 25 of the sidewall 18 to be removed to display contents in the container C. Although the tear out panel 25 is shown as being generally rectangular, it can have any desired shape.

Figure 3:
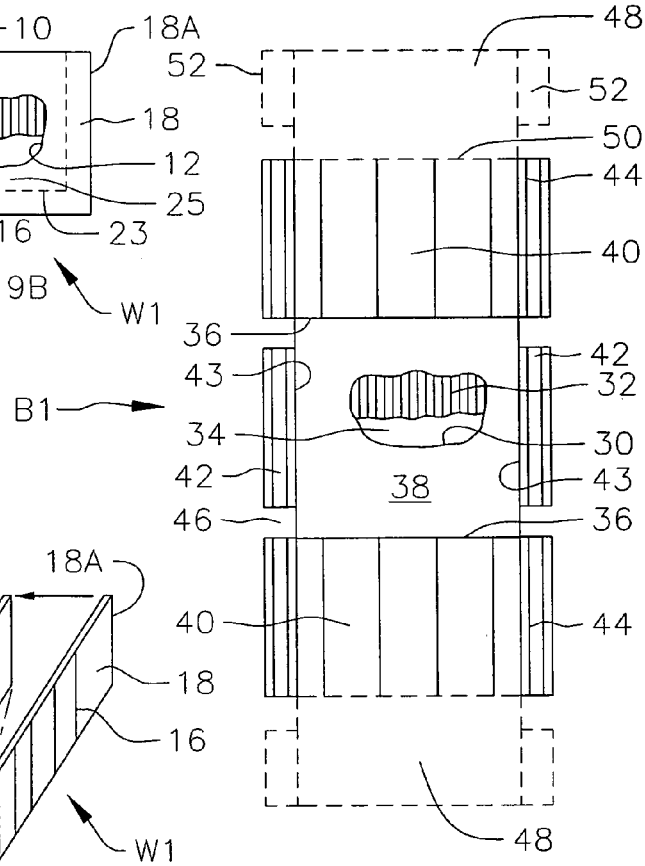
FIG. 3 is a plan view of an embodiment of a body blank for the container of FIG. 1, with a portion of one liner cut away to show the other liner and the orientation of the flutes of the corrugated material.

As shown in FIG. 3, body blank B1 is of substantially rectangular planform and comprises an inner layer 30, corrugated medium 32 and outer paper layer 34. Traversing the long axis of the piece, a pair of parallel fold lines 36 divide the area of the blank B1 into a substantially rectangular central bottom panel 38 flanked at opposite ends by a pair of end wall panel areas 40. Along each of its opposite sides, the bottom panel 38 is formed with a marginal pair of integrally formed window flanges 42 by fold lines 43. In similar fashion, each of the pair of end wall panel areas 40 is provided on opposite sides with an integral pair of corner post flanges 44. Preferably, the corner post flanges 44 extend linearly the full length of the end wall areas 40 corresponding to the vertical dimension of the completed container. In that case, the window flanges 42 of the bottom panel 38 are shorter than the corresponding dimension of the bottom panel to define notches 46 at opposite ends of the flanges to leave clearances for the rotation of the corner post flanges 44 into position when the container is assembled. Preferably, each notch 46 is of substantially the same width as the corner post flange 44. The central bottom panel 38 is thus defined generally by a perimeter that is outlined by fold lines 36 and 43 and the notch 46.

Alternatively, adjacent ends of the window flanges 42 and corner post flanges 44 could be beveled, or the window flanges 42 lengthened and the corner post flanges 44 shortened to define alternative joint geometries, as well understood in the art. If it is desired to have a container with an integral cover or lid, rather than a separately formed tray lid or the like, such may be provided by the cover flaps 48 shown in phantom outline in FIG. 3. Each of these is an integral extension of one of the opposite ends of the blank B whose inside boundary comprises a fold line 50 coincident with an upper end boundary of one of the end wall areas 40. The opposite sides of each cover flap 48 may be provided with integral foldable flaps 52.

Figure 4:
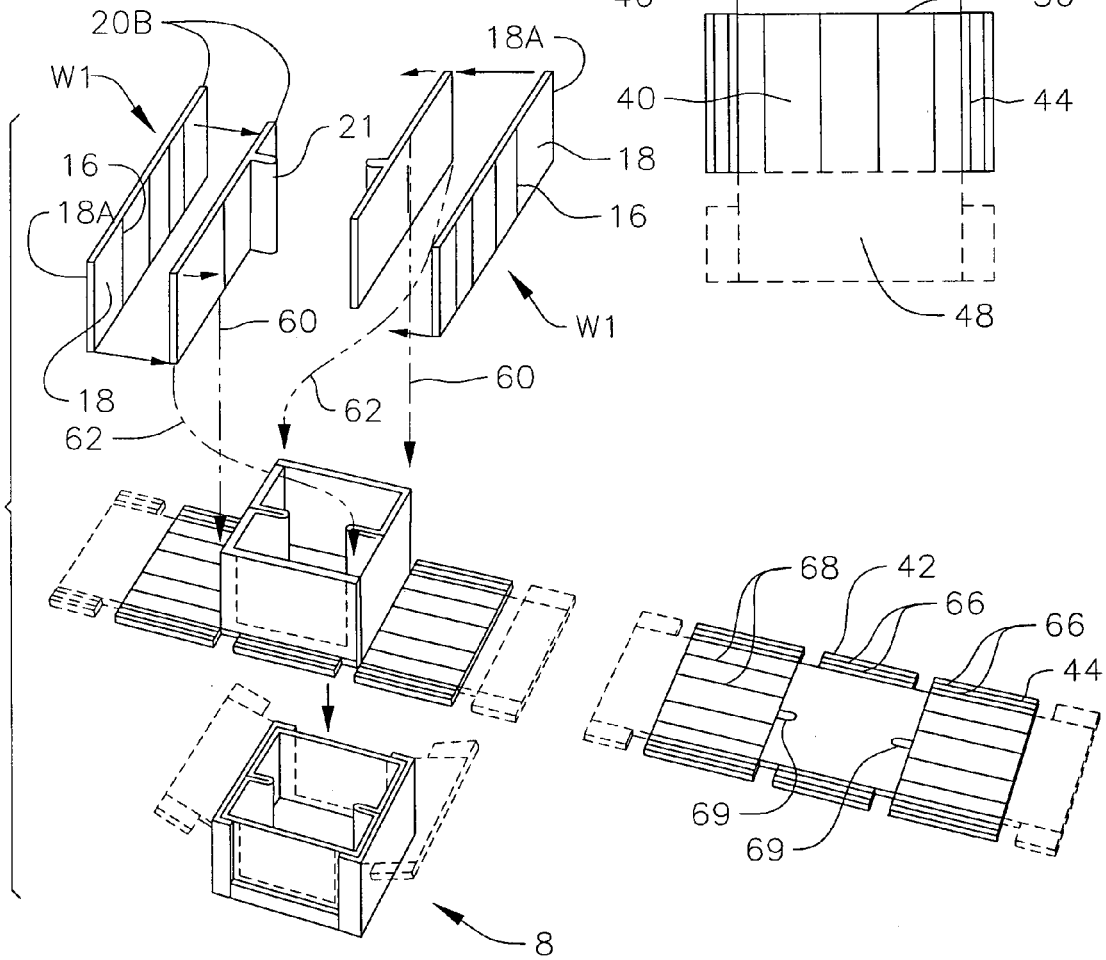
FIG. 4 is a schematic diagram illustrating the relative orientation of a pair of wall blanks of FIG. 2 and a corresponding body blank of FIG. 3 being brought together during assembly of a container of FIG. 1.

A completed container 80 of the first embodiment of the invention is shown in FIG. 1, fabricated from a companion set of blanks comprising an identical pair of the wall blanks W1 and a single body blank B1. As is indicated in FIG. 4, an identical pair of the wall blanks W1 are disposed in laterally spaced parallel vertical planes with their end wall areas 20 in registration with one another and in superposition within and over opposite ends of the central bottom panel 38 of the blank B. To prepare the wall blanks W1 for assembly with body blank B1, the T-extension portions 21A and 21B are brought together by bending along score lines 17A, 17B and 17C, so that the T-extension portion is generally perpendicular to end wall portions 19A and 19B and so that end wall portion has the correct dimensions. As indicated by lead lines 60, the vertical fold lines 16 of the pair of blanks W1 are disposed in intersecting alignment with diagonally opposite corner areas of bottom panel 38. The sidewalls extend in opposite directions and each sidewall 18 of the pair of blanks W1 is rotated 90 degrees about the corresponding fold line 16 to bring its distal end 18A into abutment with a butt edge 20B of the other blank W, as indicated by lead lines 62. An inner wall of the completed container thus comprises the length of an end wall 20 of a blank W1 and a thickness X of the other blank W. The blanks W1 are placed generally on the central bottom panel 38 inwardly of the perimeter that is outlined by fold lines 36 and 43 and the notch 46. In the completed container C1, the T-extensions extend inside of perimeter line into the bottom 38 and provide additional stacking reinforcement strength to the container, which can be helpful if containers are stacked not in perfect registration with each other, and can also help prevent an upper container from telescoping into a lower box. When the folded pair of blanks W1 are thus in centered registration with the bottom panel 38, that is to say that the outer layers 14 of the folded pair of blanks W1 are included within the confines of the central bottom panel 38 of the blank B, body blank B1 may thereafter be erected therearound. Thus, as indicated in FIG. 4, the body blank B1 is preferably provided on its inside liner 30 with spaced, parallel plural beads of glue 66 extending along the pairs of flanges 42 and 44. Also, a plurality of parallel glue strips 68 are provided on the inside layer 30 of the end wall areas 40 of the blank B. After the folded pair of blanks W1 are in proper registration with the central bottom panel 38 of the blank W, the end wall areas 40 of the body blank B1 can be erected into mutual adhesive engagement with the outer layers 14 of the pair of blanks W1 against end walls 20. For extra strength, bead of glue strips 69 can optionally be deposited on bottom panel 38 in the vicinity of where T-extension tabs will be located to further secure them in place. Thereafter, the flanges 42 and 44 may be turned into flush adhering engagement with corresponding marginal areas of the outer surface of the pair of sidewalls 18. Optionally, mechanical fasteners such as staples could be used in addition to or in lieu of glue.

As contrasted to RSC and HSC containers, in the completed container 8 of this invention the container bottom comprises a single solid ply of the corrugated board material. The corrugated board material which would otherwise be used in the floor of an RSC or HSC container, in the case of the container 8 provides double laminated end walls and rigid laminated corner posts. Thus, a container of greatly increased stacking strength is provided, especially when the flutes of the end wall material are vertical. Additionally, each of the sidewall areas of the container 8 is provided with a laminated frame embodied by the window flange 42 and corner post flanges 44. Thus, without sacrificing the structural integrity of the container, each of the sidewalls can be provided with tear out panels 25 either framed by the inner edges of the window flange 42 and 44, or some other tear out shape included within that boundary.

Figure 5:
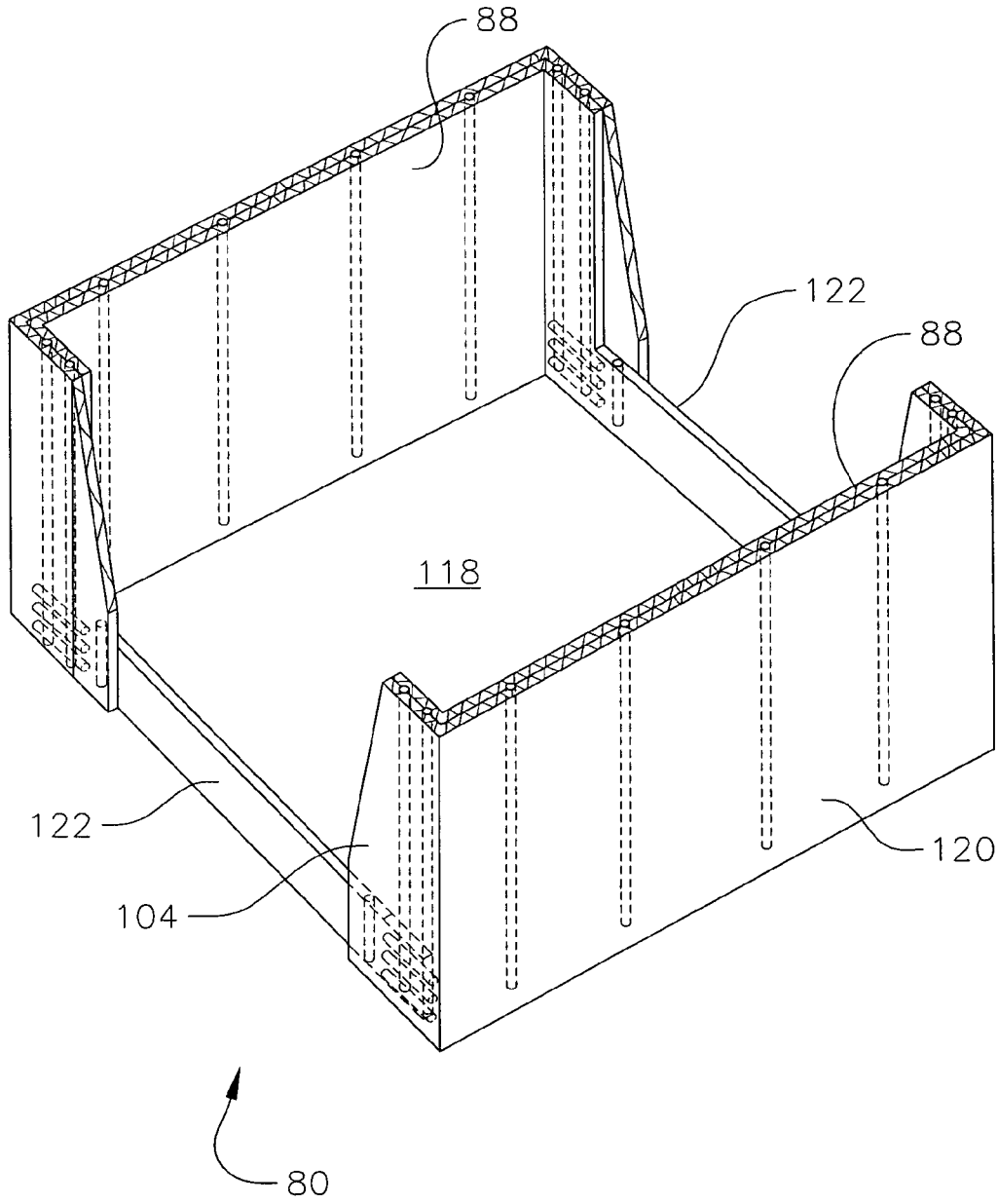
FIG. 5 is a perspective view of another embodiment of a display box container of the invention with open side portions.

FIG. 5 is a perspective view of another embodiment of an open display box container 80 of the invention with open side portions.

Figure 6:
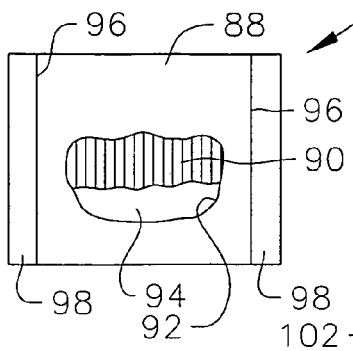
FIG. 6 is a plan view of one of the wall blanks of FIG. 5, with a portion of one liner cut away to reveal the orientation of the flutes of the corrugated medium and to show the other liner.

FIG. 6 is a plan view of one of the wall blanks W2 of FIG. 5, with a portion of one liner cut away to reveal the orientation of the flutes of the corrugated medium and to show the other liner. Wall blank W2 is a piece of corrugated liner board comprising a corrugated medium 90 of paper sandwiched between and adhesively secured to an opposite pair of planar paper liners comprising inner layer 92 and outer layer 94. Wall blank W2 is traversed by two fold lines 96 in a direction corresponding to the vertical dimension of a completed container and parallel to the flutes of the corrugated medium 90. Typically, the fold line 96 may be a press score impressed on the inner liner 92 of the blank, although other means of defining a fold line may be used such as, e.g., a perforation score, as is well understood in the corrugated board making art. Two small side flaps 98 lie to the outer sides of the fold lines 96 and are on sides of an end wall portion 88.

Figure 7:
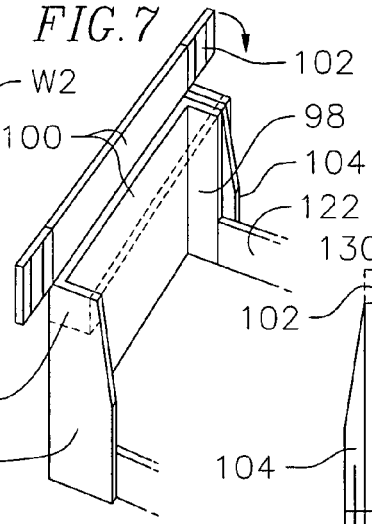
FIG. 7 is a detail showing how an optional shoulder flap of a body blank is used to provide further end wall reinforcement, with the optional shoulder flap shown in its assembled position in phantom.

FIG. 7 is a detail showing how an optional shoulder flap 100 with corner flaps 102 of a body wrap portion B2 is used to provide further end wall reinforcement, with the optional shoulder flap 100 shown attached to corner post flanges 104 of body wrap portion B1 in its assembled position in phantom.

Figure 8:
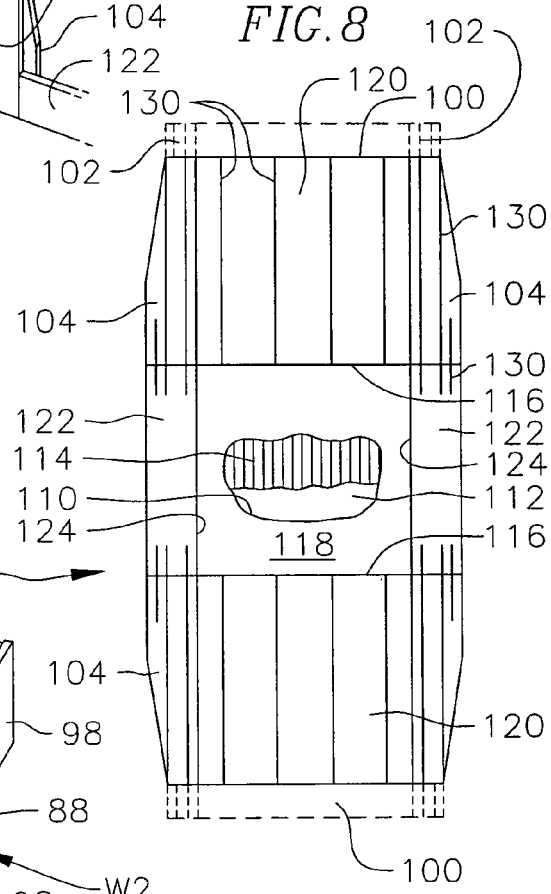
FIG. 8 is a plan view of an embodiment of a body blank for the container of FIG. 5, with a portion of one liner cut away to show the other liner and the orientation of the flutes of the corrugated material, showing the optional end flaps.

FIG. 8 is a plan view of an embodiment of a body blank B2 for the container of FIG. 5, with a portion of one liner cut away to show the inner liner 110, outer liner 112 and the orientation of the flutes of the corrugated material 114, and showing the optional shoulder flaps 100 with corner flaps 102. Traversing the long axis of the body wrap portion B2, a pair of parallel fold lines 116 divides the area of the body blank B2 into a substantially rectangular central bottom panel 118 flanked at opposite ends by a pair of end wall panel areas 120. Along each of its opposite sides, the central bottom panel 118 is formed with a marginal pair of integrally formed window flanges 122 by fold lines 124. In similar fashion, each of the pair of end wall panel areas 120 is provided on opposite sides with an integral pair of corner post flaps 104. Preferably, the corner post flaps 104 extend linearly to the full length of the end wall areas 120 corresponding to the vertical dimension of the completed container. Glue lines 130 are formed on the side walls 120, side flaps 104 and ends of the window flanges 122. The optional shoulder flaps 100 with corner flaps 102 of a body wrap portion B2 are shown.

Figure 9:
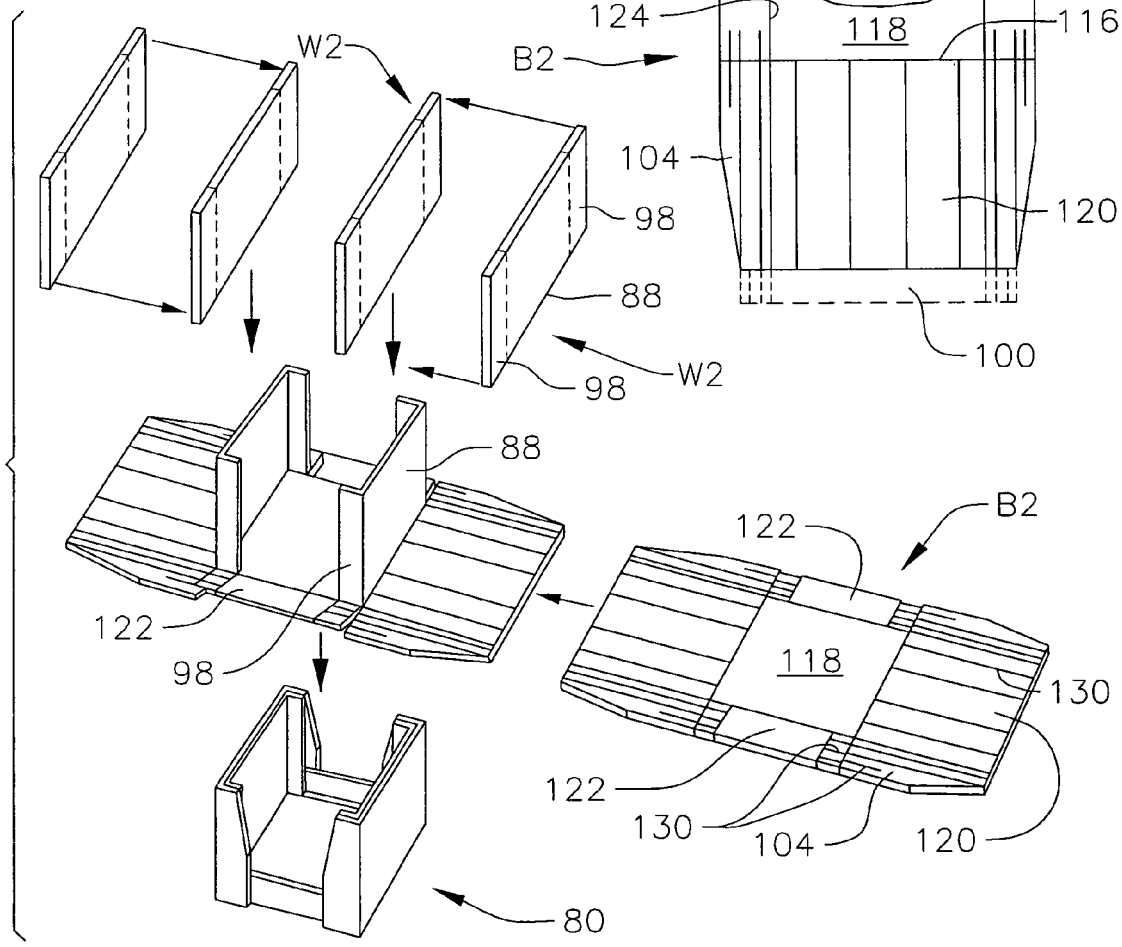
FIG. 9 is a schematic diagram illustrating the relative orientation of a pair of wall blanks of FIG. 6 and a corresponding body wrap blank of FIG. 8 being brought together during assembly of a container of FIG. 5.

FIG. 9 is a schematic diagram illustrating the relative orientation of a pair of wall blanks W2 of FIG. 6 and a corresponding body wrap blank B2 of FIG. 8 being brought together during assembly of a container of FIG. 5. As is shown, the side flaps 98 of the wall blanks W2 are bent inwardly by about 90 degrees and are placed just inside of the fold lines 116 of the central bottom panel 118 of the body wrap blank B2. The integrally formed window flanges 122 of central bottom panel 118 are folded and brought into contact with side flaps 98 so that the adhesive on corners of the window flanges 122 adhere to lower portions of the flap areas 98. The pair of end wall panel areas 120 are then folded up into contact with the outer layer 94 of end walls 88 of wall blanks W2 and the corner post flanges 104 are bent and brought into contact with the side flaps 98 where the adhesive 130 affixes the pieces together, resulting in a completed display box 80. Turning back to FIG. 5, the orientation of the end wall portion 120, window flanges 122 and corner post flanges 104 in the assembled box 80 are shown.

Figure 10:
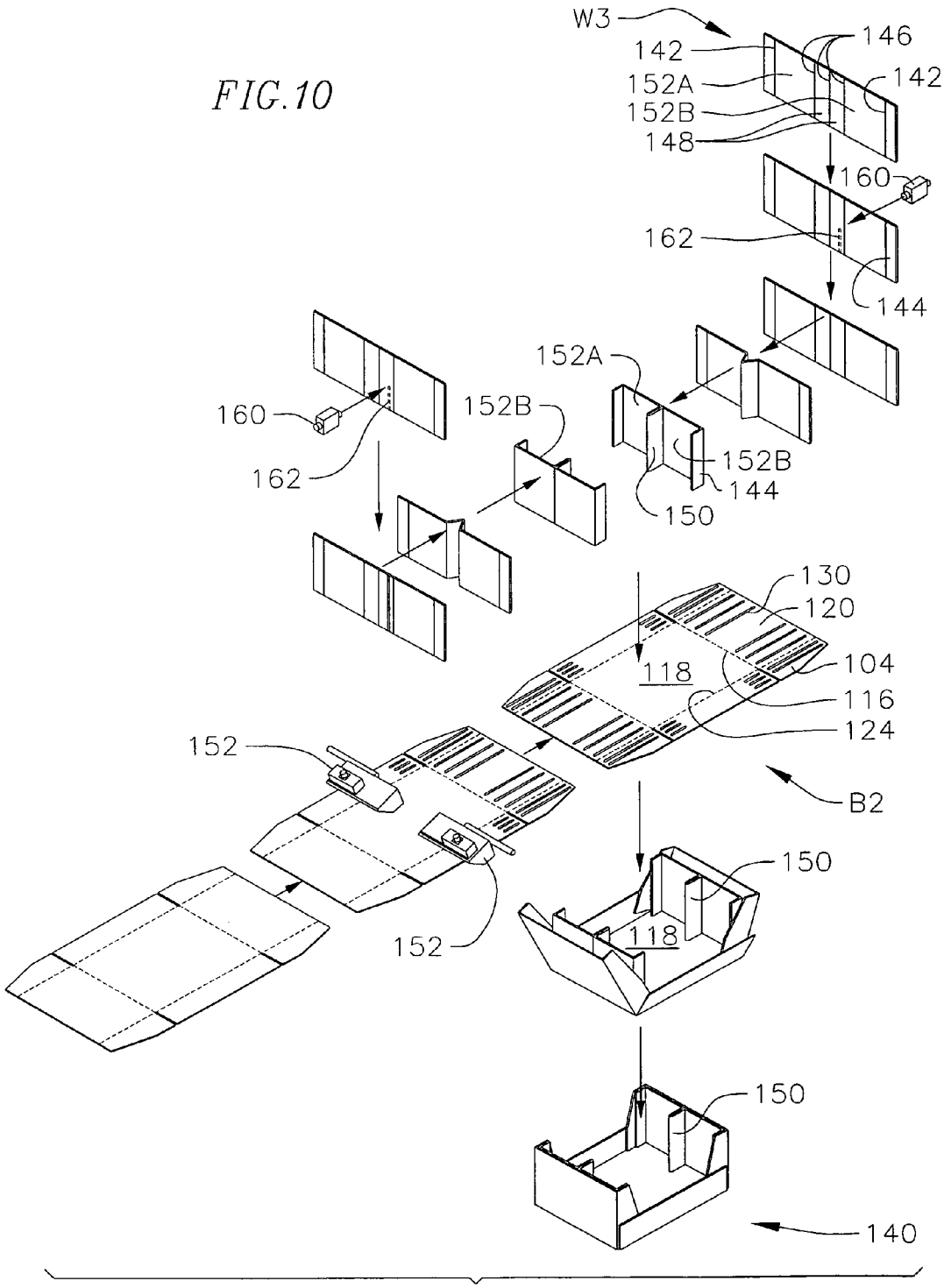
FIG. 10 is a schematic diagram illustrating the parts and steps of assembly of an open display box with a T-support.

FIG. 10 is a schematic diagram illustrating the parts and steps of assembly of an open display box with a T-support 140. The box formed by this method is very similar to that of FIG. 1 except that its end walls W3 do not include an integral side wall, but instead has two side flaps adjacent to the two end wall section. End walls W3 are constructed of corrugated cardboard with its flutes preferably oriented the same way as with the embodiment of FIG. 1. Wall blank W3 is traversed by fold lines 142 in a direction corresponding to the vertical dimension of a completed container and parallel to the flutes of the corrugated medium. These fold lines 142 form side flaps 144. Three parallel fold lines 146 form two extension walls 148 that when folded together form T-extension portions 150, and end wall sections 152A & 152B. An adhesive applicator 160 applies adhesive 162 to extension wall 148 to affix the two extension walls 148 together as T-extension portion 150. The end flaps 144 are bent inwardly by about 90 degrees. The body wall portion B2 can be identical to that shown in FIG. 8 so it is not described further. The rest of the assembly steps are the same as with FIG. 9, and adhesive applicators 152 are shown applying lines of adhesive 152 to the body wrap portion B2 and the same reference numerals are used. In the completed box, the T-extensions extend inside of perimeter line defined by the fold lines 116 and 124. If it is desired that the T-extension portion 150 be centered in end wall, then first end wall portion 152A and second end wall portion 152B will be of equal width. It is also possible for end wall to include more than one T-extension, in which case additional score lines will be formed in major wall portion. The length of the resulting T-extension portions 150 are determined by the lengths of T-extension portions 148. The assembly steps are as described in FIG. 9.

Figure 11:
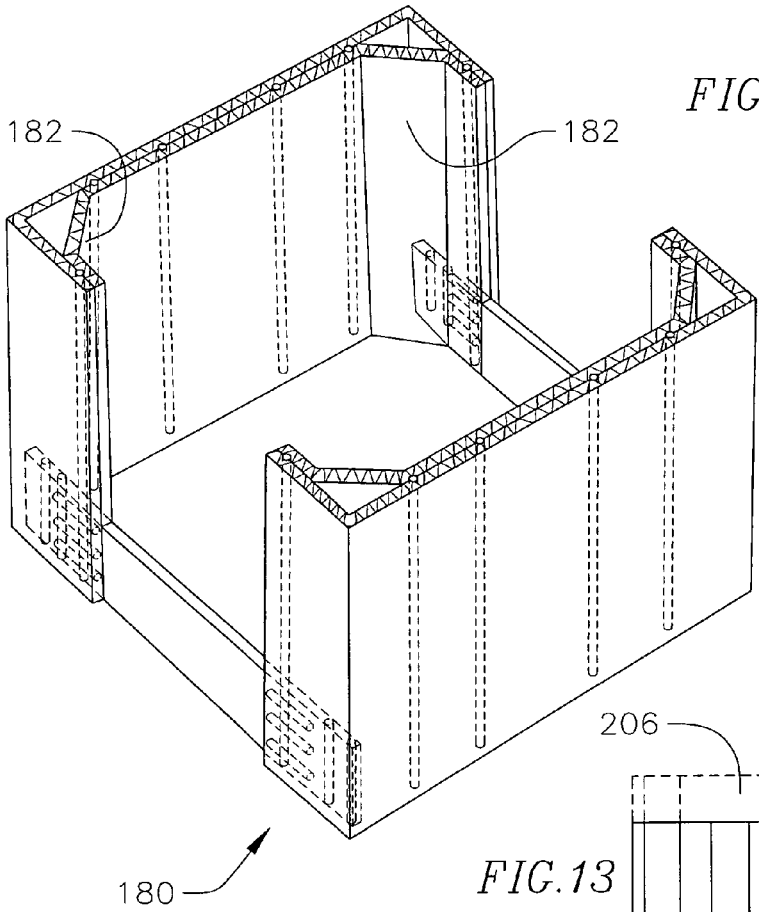
FIG. 11 is a perspective view of another embodiment of a display box container of the invention with open side portions and with diagonally oriented corner extensions.

FIG. 11 is a perspective view of another embodiment of a display box container 180 of the invention with open side portions and with diagonally oriented corner extensions 182. In this display box, no T-extensions are shown, but a T-extension could be included in this box design as well.

Figure 12:
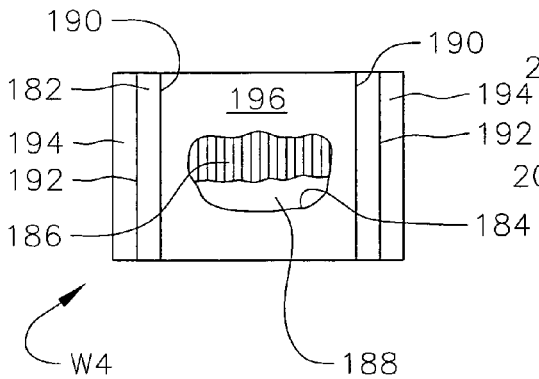
FIG. 12 is a plan view of one of the wall blanks of FIG. 11 with diagonally orientatable corner extensions, with a portion of one liner cut away to reveal the orientation of the flutes of the corrugated medium and to show the other liner.

FIG. 12 is a plan view of one of the wall blanks W4 of FIG. 11 with diagonally orientable corner extensions 182, with a portion of the liner 184 cut away to reveal the orientation of the flutes 186 of the corrugated medium and to show the outer liner 188. Fold lines 190 and 192 defined diagonally oriented corner extensions 182, and end flaps 194 are used to secure the diagonally oriented corner extensions 182 in place in the completed container 180. To assemble the container 180, the diagonally oriented corner extensions 182 are bent about 45 degrees along fold lines 190 and the end flaps 194 are bent about 45 degrees along fold lines 192 from the end wall portion 196.

Figure 13:
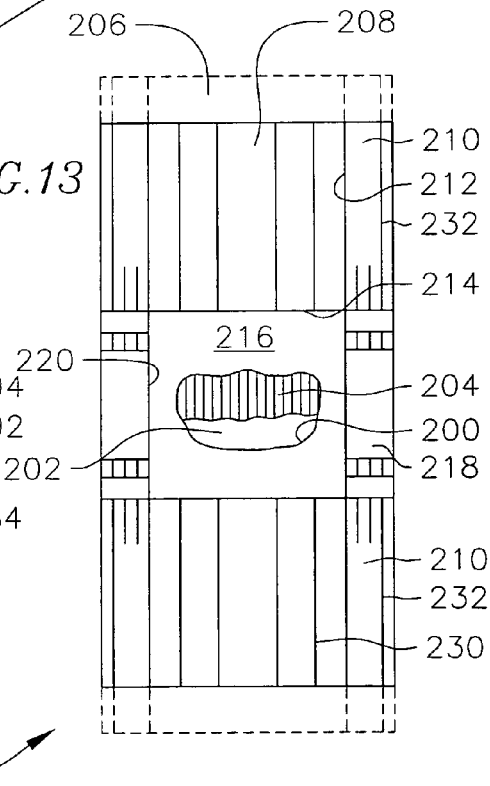
FIG. 13 is a plan view of an embodiment of a body blank for the container of FIG. 11, with a portion of one liner cut away to show the other liner and the orientation of the flutes of the corrugated material, and showing optional end flaps.

FIG. 13 is a plan view of an embodiment of a body blank portion B4 for the container of FIG. 11, with a portion of the inner liner 200 cut away to show the outer liner 202 and the orientation of the flutes 204 of the corrugated material, and showing optional shoulder flaps 206 extending from side walls 208. Side walls 208 have integral side flaps 210 formed by fold lines 212, and side walls 208 are formed by fold lines 214 forming a portion of the perimeter of a base portion 216. Window flanges 218 extend from the sides of the bottom wall 216 and have fold lines 220.

To assemble the container 180, the diagonally oriented corner extensions 182 of the wall blanks W4 are bent about 45 degrees along fold lines 190 and the end flaps 194 are bent about 45 degrees along fold lines 192, and are placed on the base portion 216. The walls 208 of the body wrap portion B4 are folded up and adhesive thereon 230 are used to attach the walls 208 to the end walls 196. Adhesive 232 on side flaps 210 will adhere to end flaps 194. The resulting box thus will have high strength corners by virtue of its generally triangle corner structures, which will help not only strengthen the stacking strength of the containers, but will prevent telescoping of an upper container into a lower container. One or more T-bar extensions can be incorporated into this design if desired.

The invention further provides a method of forming a container from a preformed flat body blank and a preformed pair of wall blanks, each of the blanks being of a corrugated board material comprising a fluted media. As described above, the body blank comprises a central bottom panel defining the box's bottom perimeter and having bottom flaps and having a pair of opposite ends comprising an erectable pair of end wall panels with two side flaps. Each of the wall blanks comprises an end wall portion and at least one extension portion and at least one side portion. The method comprises the steps of:

folding each of the wall blanks such that the at least one extension portion extends inwardly from the end wall portion and folding the at least one side portion orthogonal to the end wall portion;

placing the pair of folded wall blanks generally into contact with the perimeter of the central bottom panel such that the at least one extension portion extends inwardly of the box's bottom perimeter; and erecting the opposite end wall panels of the body blank into contact with the end wall portions of the folded pair of wall blanks and affixing them together, affixing the side flaps of the end wall panels to the side portions of the wall blanks and affixing the bottom flaps to the side flaps of the end wall panels, and not necessarily in that order. The affixing occurs by at least one of application of adhesive and staples.

What is claimed is:

1. A method of forming a three-piece container from a preformed flat body blank and a preformed pair of separate individual wall blanks, each of the separate individual wall blanks being of a corrugated board material comprising a fluted media, the body blank comprising a central bottom panel having a length and a width and defining the box's bottom perimeter and having window flanges and having a pair of opposite ends comprising an erectable pair of end wall panels with two corner post flanges, each of the separate individual wall blanks comprising an end wall portion and at least one T-extension portion and at least one side portion, there being formed on the end wall portion an intermediate and two equally spaced apart outer fold lines which define a pair of extension panels of equal width that are substantially less than half the width of the box's central bottom panel, which pair of extension panels when folded along the fold lines and brought and affixed together form the at least one T-extension portion, the method comprising the steps of:

folding each of the separate individual wall blanks along the intermediate and two equally spaced apart outer fold lines to bring the pair of extension panels together such that the at least one T-extension portion extends inwardly from the end wall portion and folding the at least one side portion orthogonal to the end wall portion;

without first affixing the two separate individual wall blanks together, placing the pair of folded separate individual wall blanks generally into contact with the perimeter of the central bottom panel such that the at least one T-extension portion extends inwardly of the box's bottom perimeter; and erecting the opposite end wall panels of the body blank into contact with the end wall portions of the folded pair of separate individual wall blanks and affixing them together, affixing the corner post flanges of the end wall panels to the side portions of the separate individual wall blanks and affixing the window flanges to the side panels of the separate individual end wall portions, and not necessarily in that order.

2. The method of claim 1, wherein the affixing occurs by at least one of application of adhesive and staples.

3. The method of claim 1, wherein the separate individual wall blanks comprise two side portions that are substantially less than half the width of the bottom panel of the body blank and are in the form of side flaps, and in the step of affixing the window flanges to the side panels of the separate individual end wall portions the width of the three piece container will remain substantially open.

4. The method of claim 1, wherein the separate individual wall blanks comprise two side portions that are pre-scored to provide tear out window panels that can be removed after final assembly of the container, and tearing out the tear out window panels to reveal the interior of the container.

* * * * *